United States Patent [19]

Kelly et al.

[11] Patent Number: 4,600,468

[45] Date of Patent: Jul. 15, 1986

[54] MACHINE FOR EFFICIENT ASSEMBLY OF BIASED YARN ARRAYS

[75] Inventors: Robert G. Kelly, Latham; Walter G. Spang, Saratoga Springs, both of N.Y.

[73] Assignee: Norton Company, Worcester, Mass.

[21] Appl. No.: 672,987

[22] Filed: Nov. 19, 1984

[51] Int. Cl.[4] ..... D04H 3/05; B32B 5/12

[52] U.S. Cl. ..... 156/440; 156/177; 156/441

[58] Field of Search ..... 156/177, 181, 441, 439, 156/440, 178, 179; 28/101, 102; 66/8.4 A; 428/105, 107, 113

[56] References Cited

U.S. PATENT DOCUMENTS

| | | | |
|---|---|---|---|
| 2,772,718 | 12/1956 | Magnuson | 156/181 |
| 3,321,348 | 5/1967 | Rupp | 156/440 |
| 3,756,043 | 9/1973 | Kemter | 66/84 A |
| 3,761,345 | 9/1973 | Smith | 428/113 |
| 3,771,330 | 11/1973 | Carman | 156/439 |
| 4,325,999 | 4/1982 | Campman et al. | 156/181 |
| 4,528,214 | 7/1985 | Long et al. | 427/173 |

*Primary Examiner*—Michael Ball

*Attorney, Agent, or Firm*—Frank S. Chow

[57] ABSTRACT

This invention provides a machine for efficiently laying out biased arrays of yarns. The machine combines on a single supporting machine frame (1) two mechanically driven continuous yarn carrier strips, each provided on its edge facing the other carrier strip with a plurality of spaced yarn restrainers, and (2) a reciprocating conveyor capable of conveying a small array of spaced parallel yarns, oriented at an angle to the motion of the carrier strips between 10°-80°, back and forth between the two carrier strips in such a manner that the yarns will be held on the restrainers at each pass of the conveyor. Continuous yarns are supplied by conventional means under constant low tension to the input of the conveyor. The relative motions of the carrier strips and the reciprocating conveyor are controlled so that the web of yarns produced is regularly patterned.

The best means for generating reciprocal angled motion combines (1) a first sliding carriage free to move back and forth in a direction perpendicular to the direction of motion of the yarn carrier strips, under the urging of a rotating drive bar moving in a slot of this carriage, (2) a second sliding carriage suspended from the first sliding carriage by tracks which allow it to move back and forth in a direction parallel to the direction of motion of the carrier steps, and (3) a guide plate attached to the main machine frame. A projection from the second sliding carriage fits into an angled slot in the guide plate to constrain the motion of the second sliding carriage to the desired path. A device for holding several yarns parallel to each other as they are drawn out is attached to one end of the second sliding carriage.

8 Claims, 7 Drawing Figures

MACHINE FOR EFFICIENT ASSEMBLY OF BIASED YARN ARRAYS

BACKGROUND OF THE INVENTION

1. Field of the Invention

This invention relates to machines which lay out spaced assemblies of textile yarns or similar fiber structures. The general field would include conventional looms and knitting machines along with more specialized equipment such as that described in U.S. Pat. No. 4,249,981 to Pelletier. However, unlike the vast majority of such machines, this invention relates to laying out yarn arrays which are eventually incorporated into a continuous web in which the yarns are neither parallel nor perpendicular to the edges of the web but inclined at an angle thereto between ten and eighty degrees. This invention is particularly adapted to laying out yarns which are kept substantially straight and are not woven, knitted, sewn, or otherwise regularly distorted from a straight path, except to the extent necessary at the edges of the web to form a selvage or similar structure.

This invention is most particularly adapted for laying out straight laid narrowly multidirectional yarn arrays such as are disclosed in an application for United States Patent entitled "Improved Joining Tape and Process Therefor" by applicants Dhiraj H. Darjee and Daniel E. Devine, filed on the same date as this application and assigned to the same assignee as this application under Ser. No. 672,988.

As outlined in more detail in said application by Darjee and Devine, hereinafter cited simply as Darjee, a common requirement of industry and commerce is to convert a material manufactured in continuous web form into an endless belt. One of the most common methods for accomplishing this purpose is called a butt joint. A reinforcing material, variously called a tape, patch material, etc. is usually added to one side of the butt joint to strengthen it.

The particular type of tape described by Darjee is used primarily for joining coated abrasive products into endless belts. Such joints are normally made at an angle other than perpendicular to the edge of the belt. The Darjee tape is reinforced with yarns for increased tensile strength, and it is naturally advantageous for these reinforcing yarns to be oriented in or near to the running direction of the belts made with it. For reasons detailed by Darjee, the most practical method of achieving this goal is to lay out the yarn array during the manufacture of the tape with the yarns at an angle to the edge of the layout. In order to avoid a tendency of the patch material to split under certain types of stress, the yarns are not laid out strictly parallel to one another, but instead in two groups. Yarns within each group are parallel, but the two groups cross each other at a small angle up to 5°.

2. Description of the Prior Art

Triaxial weaving machines, which lay out two groups of yarns corresponding to the fill of a conventional fabric at both sixty degree angles to the warp yarns, are known but are believed to be little used. Knitting and stitch-bonding machines which can lay out yarns in angled patterns are also known. However, all these machines are designed primarily for making fabrics and thus normally require that at least some of the yarns used be interlaced, knitted, or otherwise repeatedly diverted from a straight path. The Pelletier machine already noted lays out what are called "weft webs" in which the yarns are straight, but it is adapted only to laying out such webs with the yarns perpendicular to the edges of the webs. We are not aware of any prior art machine efficiently adapted to laying out biased webs of straight laid yarns at variable angles to the edge of the webs.

SUMMARY OF THE INVENTION

We have found that an effective machine for laying out biased arrays of straight laid yarns can be constructed by combining on a single machine frame two mechanically driven continuous yarn carrier strips, each provided on its edge facing the other carrier with a plurality of spaced yarn restrainers, and a reciprocating conveyor capable of conveying a small array of spaced parallel yarns, oriented at the desired angle or angles, back and forth between the two carrier strips in such a manner that the yarns will be retained on the restrainers during each complete cycle of the reciprocating conveyor. Continuous yarns are supplied by conventional means under constant low tension to the input of the conveyor. The relative motions of the carrier strips and the reciprocating conveyor are controlled so that the web of yarns produced is regularly patterned. If the motion of the carrier strips is discontinuous in a properly coordinated manner, all the yarns laid out will be parallel to each other. If the motion of the carrier strips is continuous at the proper speed, two sets of mutually parallel yarns intersecting the yarns of the other set at small angles will result.

The basic machine for laying out biased webs may advantageously be combined with conventional laminating and/or liquid adhesive coating and processing equipment to encapsulate the yarn array and make it into joining tape. A means for compressing the combined array of yarns and adhesive is also a useful adjunct. Conventional unwind stands, windup rolls, web guiding equipment, and slitters may also be advantageously combined for continuous commercial operations.

The conveyor means for laying out yarns at an angle may conveniently consist of two parts: (1) a yarn guiding section capable of maintaining a small array of several yarns in properly spaced parallel and planar array as it moves and (2) means for generating reciprocal angled motion of the guiding section across the width of the space between the two carrier strips.

The guiding section can consist of (1) upper and lower vertically fixed yarn guideboards containing a pattern of eyelets through which individual yarns are threaded and (2) two yarn depressors, one on each side of the lower guideboard, which are capable of moving up and down at appropriate times during the travel of the guiding section to control the vertical position of the yarn.

The means for generating reciprocal angled motion can consist of (1) a first sliding carriage which slides back and forth in a first direction, preferably perpendicular to the direction of motion of the yarn carrier strips, under the urging of a rotating drive bar moving in a slot of the first sliding carriage and (2) a second sliding carriage suspended from the first sliding carriage by tracks which allow it to move with respect to the first sliding carriage in a direction substantially divergent from, preferably perpendicular to, the direction of sliding of the first sliding carriage. A projection from the second sliding carriage fits into an angled slot cam in a guide plate attached to the main machine frame, so that the extent of motion of the second sliding carriage in the direction in which the yarn carrier strips travel is controlled for any position between these yarn carrier strips which the second sliding carriage can assume. The yarn guiding section may be attached to one end of the second sliding carriage.

DESCRIPTION OF THE PREFERRED EMBODIMENTS

The yarn carrier strips may be made of any material suitable for an endless belt capable of precise mechanical motion. Thus cloth or rubber belts, perforated metal strips, commercial tenter chains, etc. could all be used. However, our preferred carrier strips are composed of conventional triple width steel drive chain capable of being joined into endless carrier strips of any desired length which is an integral multiple of the length of the chain links, about 12 mm. The triple width gives the chain suitable stiffness to maintain precise alignment in the parts of its path from the point where it receives newly laid down yarns to the point of yarn encapsulation. The chain is designed to be driven by a toothed wheel which can be powered by an electric motor for precise speed control.

A wide variety of mechanical devices could also serve as the actual yarn restrainers which are attached to the carrier strips. It will be apparent to those skilled in the art that the design of the yarn restrainers must be correlated with that of the reciprocating yarn conveyor which moves the yarns between the two carrier strips, so that the restrainer can smoothly accept the spaced yarn array from the guiding section and maintain the yarn array in proper spacing as the carrier strips move toward the adhesive encapsulation zone. Thus a conventional pin tenter chain might be employed with a guiding section which passes the small yarn array over the pins and any suitable conventional device, such as a wire brush wheel, for forcing the looped sections of the yarns formed at the edges of machine over the pins so that the yarns will be retained thereon. With sufficiently stiff yarns conveyed between the carrier strips by a device which remained inward of the small yarn array during its travel toward the carrier strip, a clip tenter could be used. Yarn restrainers of the type described by the already cited Pelletier patent might also be used, although for our purposes it would be necessary to modify the Pelletier mechanism so that the line connecting the opening points of the compressible blocks which restrain the yarns in that design would make a biased angle with the direction of forward motion of the carrier strips. This design would not be expected to be convenient for our purposes, because it would likely be awkward to adjust the points of block opening to correspond to a variety of angles for laying out the yarns.

Figure 7:
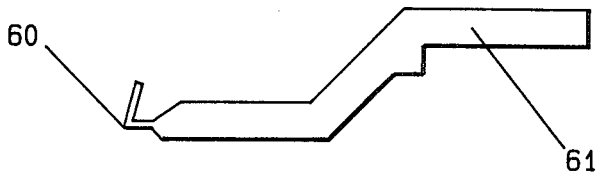
FIG. 7 is a view from the left side of FIG. 1 of a yarn restrainer of the preferred type, a small hook with its opening on the top; these are attached to the rear edge of front carrier strip 50 of FIG. 1.

Our preferred yarn restrainers, for use in conjunction with the yarn conveying mechanism to be described below and with yarns from about 150 to 600 denier, are small hooks capable of being spaced within 1 mm of each other in an even spacing along the entire length of the chain carrier strips. Convenient units of sixteen such hooks 60 cast with a single shank may be obtained from Unitechna Aussenhandelgesellschaft, DDR-108 Berlin, Mohrenstrasse 53/54. The shape of these hooks is shown in FIG. 7. Such sets of hooks are attached to the inner part of the carrier chain links in such a way that any straight section of the path of the carrier chain has uniformly spaced hooks, with their openings facing upward as shown in FIG. 7, along the entire inner edge of the carrier chain. The hooks of preferred size for use with 220 or 440 denier polyester yarns are spaced about 0.8 mm apart and have ends beyond the angle about 5 mm long. The hook size should be adjusted as necessary for changes in yarn size and desired yarn spacing.

The preferred drive means for the carrier strips is a variable speed electric motor with conventional controls. A single motor preferably drives the yarn carrier strips, the yarn conveying assembly, and the compression rolls (if present) in order to achieve precisely coordinated motion of these components.

A wide variety of conventional yarn conveying equipment could be adapted to use in our machine. Conveyors of the Pelletier type, carrying only one or perhaps two yarns at a time should be workable, although inefficient. It is obviously preferable from the viewpoint of speed of assembly of the desired array to carry many rather than few yarns with each pass. Our preferred reciprocating yarn conveyor is an original design illustrated in FIGS. 2 and 3.

Figure 2:
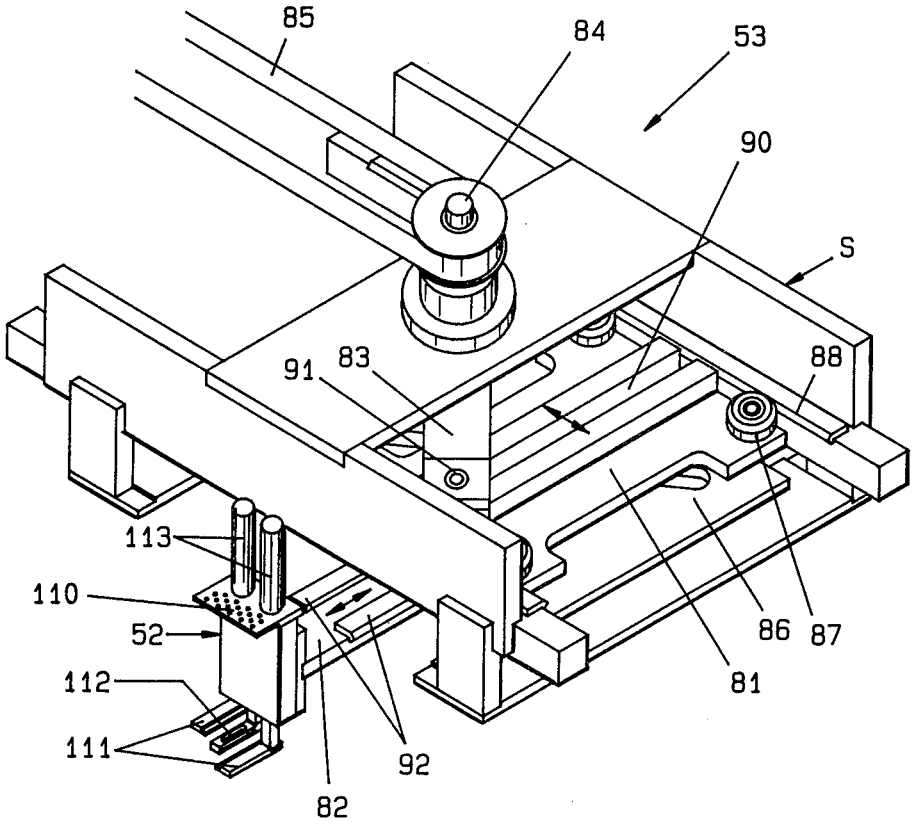
FIG. 2 is an isometric view of the parts of the machine, other than the yarn carrier chains, which control the positioning of the yarns. The line to the right of the isometric axis point which lies slightly right of the center of the lower part of FIG. 2, i. e., the line of this figure crossed by the lead lines from numbers 81, 86, and 87, corresponds to the front side of FIG. 1.

The yarn conveyor 52 is shown in FIG. 2, which also shows the attachment of the conveyor to the machinery, excluding the motor, which causes it to move reciprocally between the yarn carrier strips. This machinery is described further below. Yarns, which are not shown in any of the figures, pass from conventional storage and tensioning devices such as creels with spools, bobbins, beams, etc. under appropriate tension control to one of the eyelets shown in the upper yarn guideboard 110. These eyelets are provided with low friction plastic liners to minimize fiber abrasion. Normally each yarn is fed through an individual eyelet. If low density yarn layouts are desired, it is not necessary for every eyelet to be used. The yarns pass from the upper yarn guide board 110 to the lower yarn guide board 112, which urges the yarns into a linear configuration called a small yarn array as already noted above. Details of the array are considered further below. Yarn depressors 111 are provided on each side of the lower yarn guide board. These depressors are sufficiently long for the entire array of yarn in the position defined by the lower yarn guideboard to pass under the depressors, and the small yarn array in fact passes under the one of the depressors which is situated rearward of the direction of motion of the lower yarn guideboard during most of a cycle of the laying assembly.

The yarn depressors 111 are capable of vertical motion from a position above the tops of the yarn restrainers 60 carried on the inner part of the yarn carrier chains 50 to a position well below the point of most stable yarn positioning on these yarn restrainers. As the reciprocating yarn conveyor passes approximately the central axis of the machine on its way toward one of the carrier chains, the depressor on the rearward side of the motion of the conveyor moves to its lowest position, and the other depressor, which had been in its lowest position, rises to its highest one. The lowest position of the yarn depressors is sufficiently far below the constant vertical position of the lower yarn guideboard 112 so that the portion of the yarns between these two parts of the conveyor makes an angle of about 60° with the horizontal. With continued motion of the conveyor, the lower yarn guideboard 112, which is vertically positioned so that it barely clears the tops of the yarn restrainer hooks, pulls the small yarn array across the tops of the hooks and sufficiently far outside the line of hooks that the point of each yarn between adjacent hooks is just below the top of the hooks. Because the chains in the preferred mode of operation are moving forward continuously, this motion results in the retention of the yarns on the hooks as the conveyor begins to move backward toward the center of the machine. A looping motion of the yarn layout mechanism considered in more detail below assists in retaining the yarns. As the carrier moves past the central axis of the machine toward the other carrier chain, the two depressors again reverse vertical positions. This downward motion of what is now the rearward depressor further urges the yarn edge loops most recently formed toward the position of maximum stability on the restrainers and helps hold them in that position until the next set of yarn loops is made on the yarn restrainers borne on the opposite carrier chain.

Figure 4:
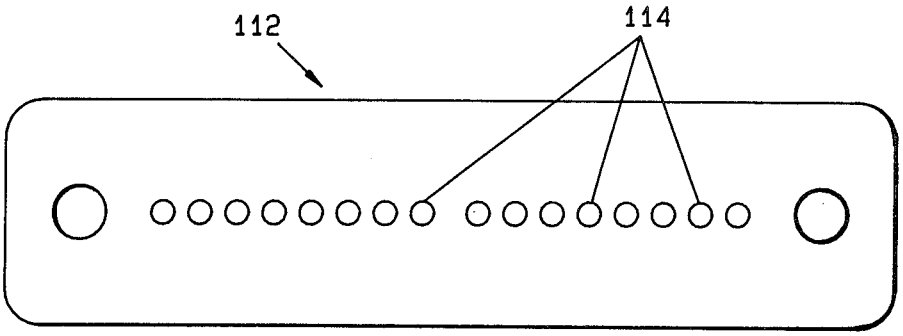
FIG. 4 is a top view of component 112 of FIGS. 2 and 3 on a substantially larger scale, showing the preferred pattern (but not the proper relative size) of the eyelets for yarn.

The pattern of eyelets in the lower yarn guideboard 112 is correlated with certain other choices in the operation of the machine. The preferred pattern of the centers of these eyelets is shown in FIG. 4, but the relative size of the eyelets is greatly exaggerated in the figure. Each eyelet 114 in this guideboard has an actual diameter of only about one millimeter and carries a single yarn. The eyelets are arranged in two groups of equal number. The spacing between eyelets is uniform within each group, but the space between the two groups is about one and one half times as large as the spacing within one group. The reason for this spacing is that in the preferred mode of operation of the machine, the yarn carrier chains are moved forward continuously during each complete cycle of the reciprocating yarn conveyor by a distance which is just one half the width of the small yarn array emerging from the lower yarn guideboard. Thus, half of the small yarn array deposited by each cycle of the laying mechanism overlaps the previously laid down small array. If the eyelets were evenly spaced throughout the entire lower yarn guideboard, an undesirable extra thickening of the overall composite yarn array held between the carrier chains would result at intervals along the line of restrainer hooks, the intervals being spaced by half the width of the small array of yarns. When the eyelets are divided into two groups and the spacing between the two groups is substantially larger than that between adjacent yarns of each group but substantially smaller than twice that spacing, the most uniform pattern of the total composite yarn array results.

A machine according to our invention can also be operated so that the carrier chain moves forward the full width of the small yarn array with each cycle. When this is done, a lower yarn guideboard with only a single group of uniformly spaced eyelets is used. In general, if n is any small positive integer, the chain can be operated at a speed to advance 1/n times the width of the yarn array, and the lower yarn guideboard should contain n groups of eyelets, all in a single straight line, with the spacing between adjacent eyelets uniform within each group but the nearest two eyelets of adjacent distinct groups spaced apart about one and one half times the spacing within a single group.

It will be appreciated by those skilled in the art that many variations in operation are possible. For example, if a lower density layout of yarn is desired, only every alternate eyelet could be filled with a yarn.

Figure 3:
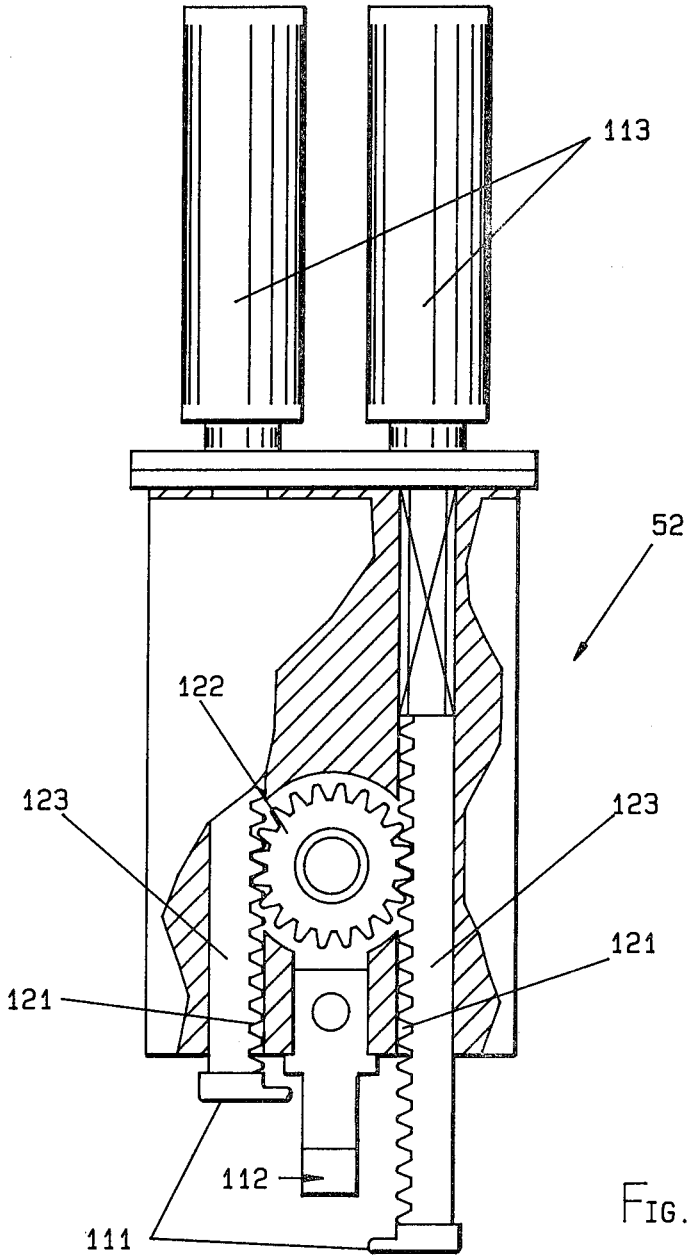
FIG. 3 is a view, partially broken away, of the mechanism 52 of FIG. 2 from the direction of the left side of FIG. 1.

The positioning of the yarn depressors is controlled in part by air cylinders 113. These are single acting spring return air cylinders with 25 mm stroke length. Further details of the mechanism 52 are shown in FIG. 3. The depressors 111 are mounted on thrust rods 123 provided with matching inner toothed tracks 121. The hatched surfaces in FIG. 3 are the cross sections of solid metal structures which define guideways for the motion of the thrust rods 123, so that the latter are constrained to move up and down only, without significant sidewise motion. The tracks 121 engage with a rotatable spur gear 122 in such a fashion that the downward motion of one of the depressor thrust rods produces upward motion of the other depressor thrust rod by the same distance. Conventional electric relays and sensors not shown determine which of the air cylinders 113 is supplied with appropriate air pressure to lower or raise its attached thrust rod and depressor, depending on the position of the yarn carrier assembly with respect to the two yarn carrier chains.

Figure 5:
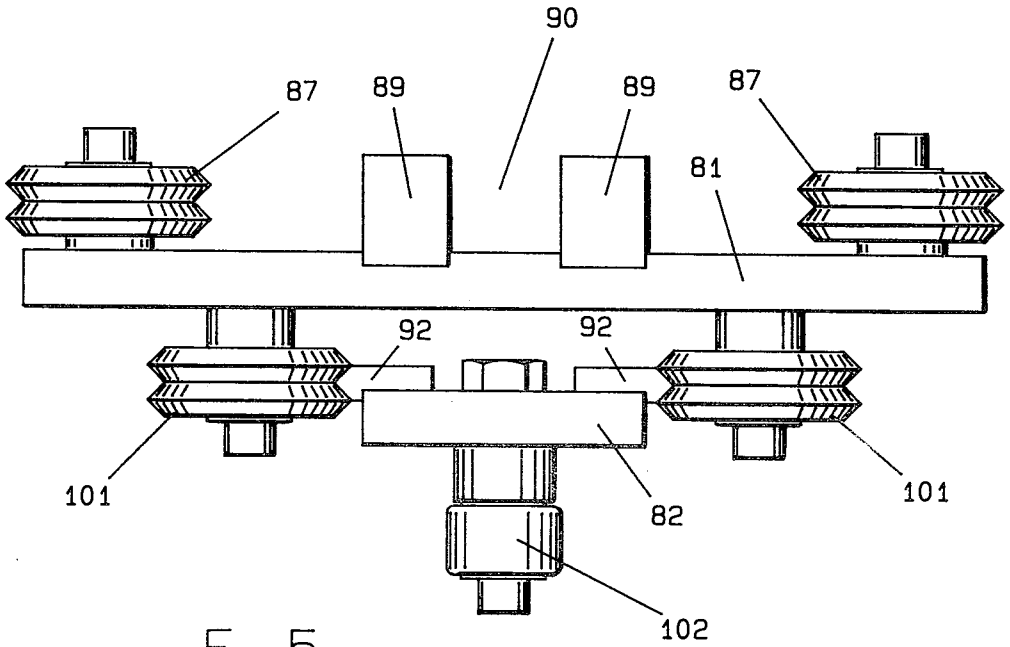
FIG. 5 is a side view of the upper and lower carriages of FIG. 2 from the direction of the arrow marked S in FIG. 2.

A variety of means for generating reciprocal angled motion could be envisioned, but our preferred means is an original design illustrated in FIGS. 2 and 5. The slideway S of FIG. 2 is rigidly attached to the machine frame F and need not move during operation of the machine. Guide plate 86 also need not move during operation but is interchangeable with alternatives for different angles of motion or other variations of operation. The moving parts of primary interest are the upper sliding carriage 81, the lower sliding carriage 82, and the upper carriage drive bar 83.

The upper sliding carriage 81 is supported by four grooved rollers 87, of which only three are visible in FIG. 2. These rollers fit into slideway tracks 88 on each side of the carriage in such a fashion that the carriage is free to move along the direction indicated by the double headed arrow shown near the end of the lead line from identifying number 81 on FIG. 2, parallel to the direction of tracks 88. This direction is preferably perpendicular to the line of motion of the yarn carrier chains. The carriage 81 bears on its upper surface a guide track 89 with a slot 90 extending across its entire width. A cylindrical guide rod 91, of which only the top is visible in FIG. 2, extends from the bottom of the guide bar 83 into the slot 90. The opposite end of guide bar 83 has a counterweight, not shown, to balance the weight of the guide rod. The guide rod has a diameter only slightly less than the width of the slot 90, so that as guide bar 83 is rotated during operation of the machine, the attached guide rod 91 urges the entire upper sliding carriage 81 back and forth along the path permitted by its sliding track. The maximum amplitude of motion of the upper sliding carriage 81 is sufficient to extend across a width slightly larger than the distance between the sets of yarn restrainers borne on the two yarn carrier chains 50, which determine the width of the web of patch material to be made. Guide bar 83 is driven by shaft 84 which in turn is driven by belt 85, which is driven by an output from the same electric motor as the carrier chains.

On the bottom of the upper sliding carriage are fixed four additional rollers 101 essentially identical to those on the top. These bottom rollers can not be seen in FIG. 2, but two of them are shown in FIG. 5. (Parts of mechanism 52, which although at the rear might otherwise be visible in FIG. 5, have been omitted.) The lower sliding carriage 82, with attached tracks 92, fits between and is suspended by the rollers 101 and can move along the direction defined by the tracks 92 between the rollers 101; this direction of motion is shown by the double headed arrow near the end of the lead line from designating number 82 on FIG. 2. Thus the lower sliding carriage 82 can move with respect to the upper sliding carriage 81 along the direction perpendicular to that along which the upper sliding carriage can move with respect to the main machine frame. (Some other angle than perpendicular between the two sliding directions of the the two sliding carriages could be used, but the machine would have to be made larger to cover the same width between the carrier strips and the range of layout angles needed.)

Because the lower sliding carriage is carried by and thus partakes of the motion of the upper sliding carriage, a given point on the lower sliding carriage can, within the constraints of these two motions, assume any position within a rectangle broad enough to span the distance between the lines of yarn restrainers on the yarn carrier chains and long enough to reach from one set of yarn restrainers to the opposite one when moving at an angle with respect to the yarn carrier chains which is desired for the straight laid yarns.

The actual positions which the lower sliding carriage will assume in operation are determined by the interaction of a cam follower 102, attached to the lower sliding carriage 82, with a guiding cam 104 cut in guide plate 86. An edge portion of the guide plate is shown in FIG. 2. A top view of the guide plate, showing the preferred exact shape of the guiding cam, is given in FIG. 6. The central portion of the guiding track or cam 104 consists of a parallel edged slot with width just slightly wider than the diameter of cam follower 102. The central axis of this slot is inclined an an angle X to the transverse edges of the guide plate. The angle X corresponds to the complement of the central angle with respect to the edges of the yarn carrier chains around which the yarn array will be laid out by operation of the machine, and the length of the track formed by cam 104 is sufficient so that at each end of its travel, the reciprocating yarn conveyor will convey the yarns being laid down slightly outside the line of yarn restrainers on that edge.

Figure 6:
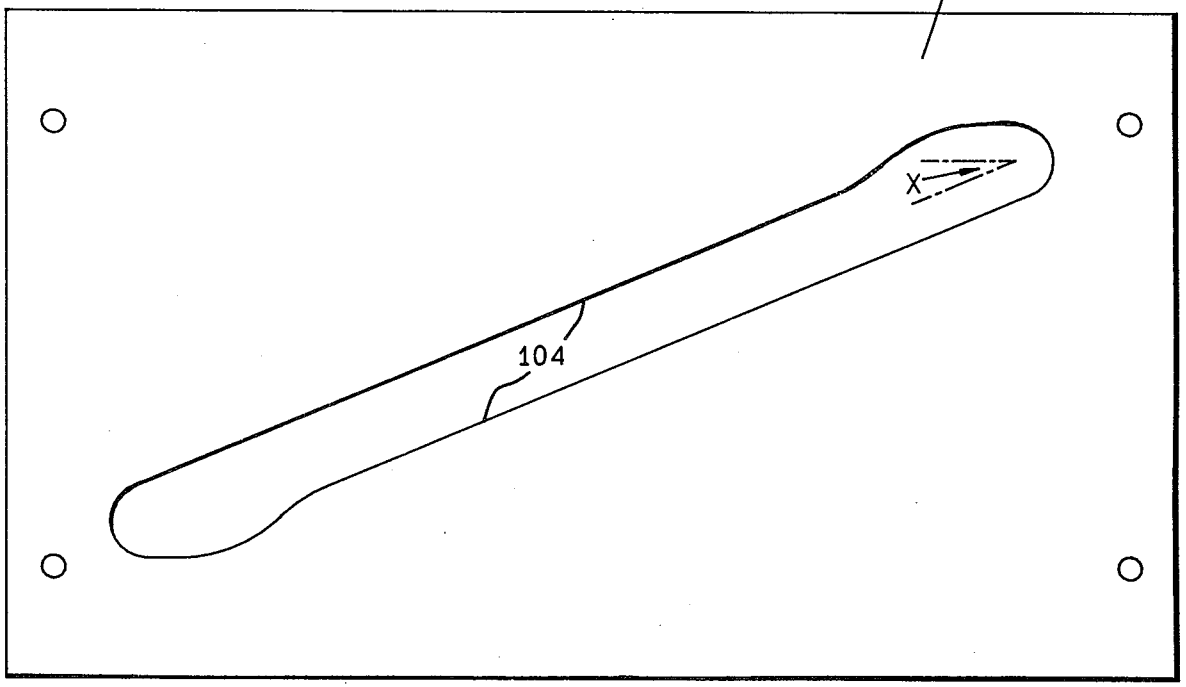
FIG. 6 is a top view of guide plate 86 of FIG. 2.

One side of the cam slot 104 at each end is widened by a curved portion as shown in FIG. 6. The purpose of this widening is to cause the yarn carrier to move from one extreme end of its travel back toward the center line of the machine in a path approximately perpendicular to the carrier chain edges rather than at its usual angle to these carrier chain edges. This motion, together with the forward motion of the yarn restrainer hooks, causes the yarns to loop around the outside of the yarn restrainers on its return path. The shape of this widened section of cam 104 does not appear to be critical, but the shape shown in FIG. 6 has the advantage of generating a relatively smooth motion of the yarn carrier which reduces mechanical wear.

As the position of the yarn conveyor returns to control by the main part of the guide cam 104, the yarns being conveyed are pulled by the tension of the conveyor back into the desired angle with respect to the carrier chain edges, leaving only a small loop around the restrainer hook to hold the yarn in place until it is encapsulated with adhesive. The edge part of the web which includes the looped ends of yarn is discarded after encapsulating and slitting.

The guide plate 86 is affixed to the machine frame by bolts, so that it can be easily changed for different angles of operation.

In the preferred mode of operation for the manufacture of narrowly multidirectional belt joint tape or patch material, the motion of the carrier strips is continuous when the reciprocating yarn conveyor is operating. If for any reason, a web in which essentially all yarns are parallel is desired, this can be accomplished by a conventional mechanism which will alternately stop and start the carrier strips in proper correlation with the motion of the yarn layout means. In such a situation, additional means might be needed for urging the yarns onto the hooks or other restrainers when the lower yarn guideboard is outside the line of hooks, if the forward motion of the chain was not sufficient for this purpose.

Figure 1:
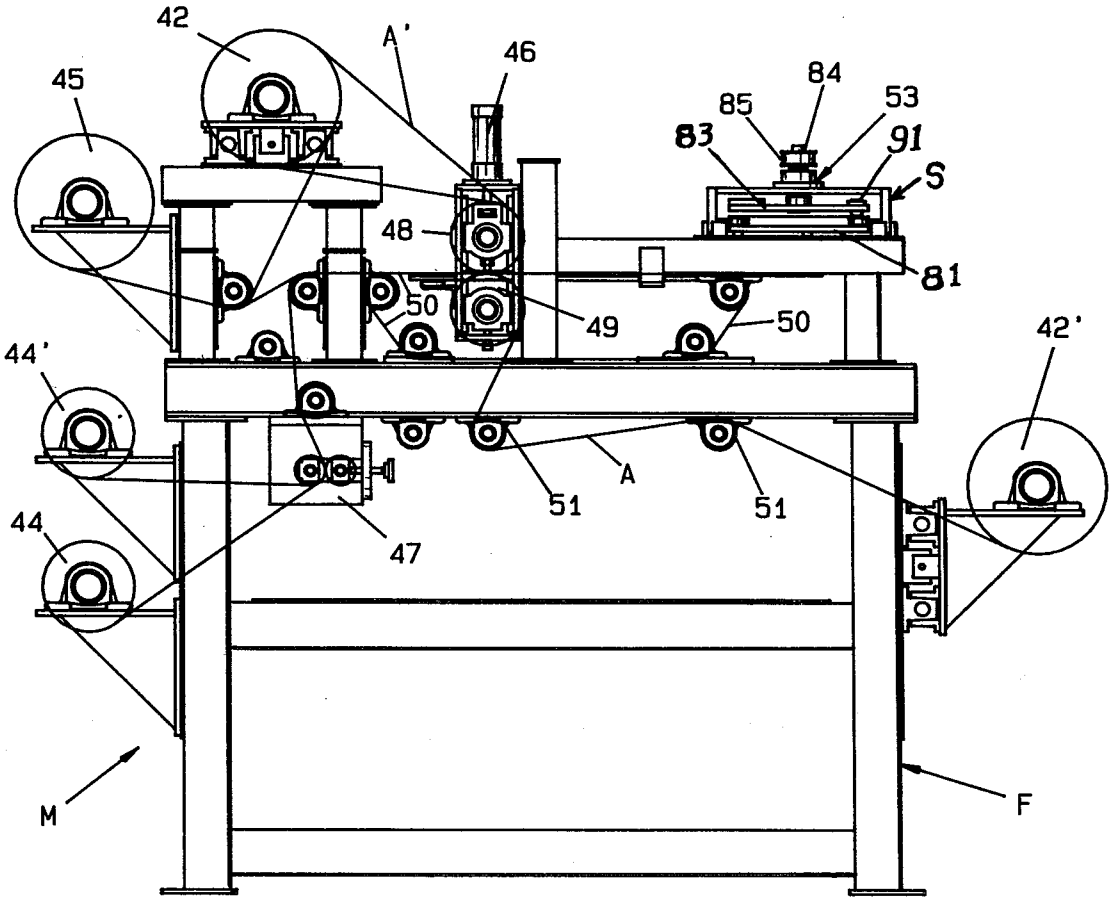
FIG. 1 is a front view of a preferred machine incorporating several conventional elements along with the essentials of our invention.

The essential and original components of the machine of our invention as described above can advantageously be combined with previously known components for some uses. A preferred embodiment of such a machine suitable for making coated abrasive belt joint tape or patch material on a large scale is shown in FIG. 1. The main framework F is constructed of welded, heavy duty tubular steel, has machined pads on mounting surfaces, and is self-supporting. The entire machine can be moved as a unit while maintaining its dimensional integrity.

Unwind stands 42 and 42' are rigidly mounted directly to the machine frame. Webs A and A' of dry film adhesive, with or without auxiliary webs, can be supplied from these unwind stands to the laminating station 46. Windup roll 45 is used to store any release paper or similar material supplied on adhesive web A' but not desired in the final patch material. After lamination, the web continues to move forward in a horizontal plane under the tension generated by windup rolls 44, 44', and 45, while after only a part of this distance, the carrier strips bend downward as shown in FIG. 1. This divergence of directions detaches the web of tape or patch material from the carrier chains 50. Another divergence between the web paths separately defined by windup roll 45 and the pair of such rolls 44 and 44' then separates the tape or patch material from any web supplied with the adhesive but not desired in the patch. The patch material or tape is then slit to the desired width in score slitting station 47. The slit patch material is accumulated on the two controlled tension windup rolls 44 and 44' which jointly comprise a split winding station.

The lamination is accomplished between an upper cored rubber covered roller 48, which is adjustable in position vertically under the control of two air cylinders, and an electrically heated permanently positioned driven steel roller 49. In the direction perpendicular to the plane of FIG. 1, both these rollers fit between the two yarn carrier chains 50, of which only one is visible. These yarn carrier chains run along a path as shown in FIG. 1. Web assembly occurs in the part of the upper path of the chains between mechanism 53 and laminating rollers 48 and 49. The two chains 50 run toward the laminating rollers in this part of their path. The details of the mechanism marked 53 on FIG. 1, which lays out the yarn array, have already been described above.

All webs other than the unencapsulated yarn array are guided through the machine under proper tension and positional control by numerous ball bearing mounted steel idler rolls 51.

A typical example of the use of the machine of our invention is as follows:

EXAMPLE

The yarns for the patch material of this example were each 440 denier 100 filament number high tenacity polyester (with tenacity approximately 8 gm/denier). One such yarn was supplied to each eyelet of a lower guideboard with the pattern shown in FIG. 4. The machine described above as the preferred embodiment was used.

To start the production of patch material, the ends of the yarns of the small array were drawn through the lower yarn guideboard and tied to one or more of the yarn restrainers on one carrier chain. Power was then applied to the machine so that the carrier chains were moved continuously at such a rate that each small array of yarn overlapped half the previously laid down small array on the restrainer hooks, and the reciprocating conveyor laid down yarns between the two sets of yarn restrainers, as already described above. The yarns thus were initially straight laid in two distinct arrays which intersected each other at an angle of about 2.7°. The two arrays were arranged symmetrically around an angle of 67° to the carrier chains 50 or the edge of the web; this corresponds to 23° for the angle marked X in FIG. 6. Each of the two arrays consisted of 12 substantially evenly spaced yarns per centimeter of width (cm). The yarns of each array were parallel within 0.7° as laid out before compression. A 0.06 mm thick film of dry but readily softenable adhesive prepared according to the directions of Example 2 of U.S. Pat. No. 3,770,555 was applied to each side of the combined yarn arrays and bonded thereto under a pressure of about 40 daN/cm at a temperature of about 85° C. for a period of about 5 seconds. The patch material thus prepared was found to have a thickness of about 0.15 mm and a tensile strength of about 50 daN/cm along the direction halfway between the orientation directions of the two original yarn arrays in the patch. The volume of yarn in the patch material was about 56% of the total volume of both yarn and adhesive in the patch material.

The patch material thus formed can be used to form belts from conventionally backrubbed coated abrasive web material by a two stage pressing. The first stage is a pressing at about 10 daN/cm of width for three seconds between metal bars heated to about 149° C. The second stage is a final pressing for about thirty seconds between metal bars at a pressure of about 715 daN/cm of width. During this final pressing, the bar touching the coated side of the coated abrasive is maintained at a temperature of about 115° C., and the bar touching the patch material is maintained at about 127° C.

We claim:

1. A machine for assembling spaced biased yarn arrays, comprising:

(a) a machine frame which supports all the other components;

(b) two endless yarn carrier strips disposed on said machine frame and movable generally parallel to each other, each of said carrier strips bearing along its length on the side facing the other carrier strip a plurality of spaced yarn restrainers capable of holding individual yarns in position;

(c) yarn laying means mounted on said machine frame, having an input section, and adapted for (i) holding in a substantially straight line array in a single plane a plurality of yarns continuously supplied under light tension to said input section, (ii) extending said plurality of yarns in substantially parallel orientation while conveying said plurality of yarns in one direction accross the space between said carrier strips of part (a) along a first path making an angle of from ten to eighty degrees with said carrier strips and in the reverse direction across the space between said yarn carrier strips along a second path making an angle between 0.5° and 5° with said first path, and (iii) causing each of said plurality of yarns to be restrained by at least one of said yarn restrainers on each of said two yarn carrier strips during each complete cycle of movement of said yarn laying means from a starting position midway between the two yarn carrier strips toward one of the two yarn carrier strips, back to the other yarn carrier strip, and finally back to the starting position;

(d) means for continuously supplying continuous yarns under constant light tension to the input section of said yarn laying means;

(e) actuating means for causing said yarn laying means to move back and forth across the space between said yarn carrier strips and simultaneously advancing said yarn carrier strips at such a speed as to leave, within a continuous zone extending between said yarn carrier strips and along the direction of advancement of the said yarn carrier strips, a regularly spaced array of yarns which is moved forward along with the yarn carrier strips and their associated yarn restrainers, (f) means for encapsulating said regularly spaced array of yarns within adhesive while said array is held in the regularly spaced position in which it was laid down;

(g) means for processing said adhesive of part (f) so as to give it sufficient coherence to hold the central portion of said regularly spaced array of yarns together as part of a continuous web; and (h) means for compressing said continuous web so that the volume of yarn in the web is at least as great as the volume of adhesive, wherein said means for encapsulating said regularly spaced array of yarns within adhesive comprise means for supplying a continuous web of softenable dry film adhesive to each side of the array of regularly spaced yarns; wherein said means for processing adhesive so as to give it sufficient coherence to hole the central portion of said regularly spaced array of yarns together as part of a continuous web operate simultaneously with said means for compressing said continuous web so that the volume of yarn in the web is at least as great as the volume of adhesive, so as to encapsulate said regularly spaced yarn array within adhesive derived from said dry films; said machine further comprising:

(i) means for detaching said continuous web, formed by encapsulating with adhesive, from said yarn restrainers, and (j) means for continuously removing any portion of said continuous web which consists of yarn not encapsulated with adhesive and for slitting the remainder of such web into convenient widths for use in joining coated abrasive belts, wherein said yarn laying means comprise:

(k) a first sliding carriage capable of reciprocal motion along a first straight line direction with respect to the machine frame, said first sliding carriage having on one of its major surfaces a walled slot with its central axis oriented at a substantial angle to the direction of reciprocal motion and having on its other major surface structures defining a sliding track in which a suitably prepared component can slide reciprocally along a second straight line direction, said second straight line direction being disposed at a substantial angle to said first straight line direction;

(l) a second sliding carriage provided with structures which allow it to slide smoothly within the sliding track on said first sliding carriage, said second sliding carriage having on one end thereof means for conveying a small yarn array, said second sliding carriage also having on one surface thereof a cam follower projection;

(m) a guide plate fixed to the machine frame, said guide plate having therein a slot cam into which fits said cam follower projection from said second sliding carriage, said cam slot having camming surfaces in a shape which will constrain said means for carrying a small yarn array to follow, within a central zone centered between said carrier strips and having a width at least half the total distance between said carrier strips, a substantially linear path between said carrier strips at an angle thereto of between ten and eight degrees;

(n) a guide bar fitting within said walled slot on said first sliding carriage; and (o) means for causing said guide bar, when actuated, to rotate in a circle, thereby causing said first sliding carriage to execute reciprocal linear motion relative to said guide plate, whereby said cam slot controls the motion of said cam follower and attached second sliding carriage, all of said components having dimensions and orientations such that said means for conveying a small yarn array moves in a sufficiently wide path to carry said small yarn array into a position where the yarns of said small array can be restrained by the yarn restrainers on both yarn carrier strips during each complete cycle of motion of said means for conveying a small yarn array.

2. A machine according to claim 1, wherein said cam slot includes on each end a widened section which allows said means for carrying a small array of yarn to move backward from its farthest position outside one line of yarn restrainers at an angle to the line of said restrainers substantially different from the angle of approach to the farthest position, whereby the formation, at a position outside the line of yarn carriers, of a loop of each yarn carried is promoted.

3. A machine according to claim 2, wherein said means for conveying a small array of yarns further comprise:

(a) a yarn input guideboard having at least one eyelet therein for each yarn of the small array;

(b) a second yarn guideboard having at least one eyelet therein for each yarn of the small array, said eyelets in said second yarn guideboard being arranged in a linear pattern with at least one group of eyelets having substantially constant spacing between adjacent eyelets of each group and with a spacing between nearest eyelets of adjacent groups greater than the spacing within a single group but less than twice such spacing, said second yarn guideboard having a vertical position sufficiently high to pass over the tops of the yarn restrainers carried on the carrier strips;

(c) two yarn depressors, one on each side of said second yarn guideboard, which are long enough for the entire small array of yarns to pass underneath while maintaining the spacing corresponding to the pattern of eyelets in said second yarn guideboard, each of said yarn depressors being capable of vertical motion between a point above any portion of the yarn restrainers and carrier strips which lies inside the outermost point of reciprocating motion of said depressors and a point sufficiently far below said second yarn guideboard so that the yarns passing between the edge of said depressor and said second yarn guideboard will make a smaller angle of at least thirty degrees with the direction line of the same yarns in the portion of their disposition between said depressor and the more remote line of said yarn restrainers; and (d) means for controlling the vertical positions of the two depressors so that as the second guideboard approaches one line of yarn restrainers, the outer depressor will be in its high position and the inner depressor will be in its low position.

4. A machine according to claim 3 wherein said means for controlling the vertical positions of the two depressors comprise toothed tracks on a thrust rod for each depressor, said thrust rods being attached on their opposite end from the depressor to the output of a single acting spring return air cylinder, both of said toothed tracks being engaged with a single rotatable spur gear positioned between them so that as one thrust rod moves upward by any incremental amount, the other thrust rod is constrained by the gear to move downward by the same incremental amount.

5. A machine for assembling spaced biased yarn arrays, comprising:

(a) a machine frame which supports all the other components;

(b) two endless yarn carrier strips disposed on said machine frame and movable generally parallel to each other, each of said carrier strips bearing along its length on the side facing the other carrier strip a plurality of spaced yarn restrainers capable of holding individual yarns in position:

(c) yarn laying means mounted on said machine frame, having an input section, and adapted for (i) holding in a substantially straight line array in a single plane a plurality of yarns continuously supplied under light tension to said input section, (ii) extending said plurality of yarns in substantially parallel orienation while conveying said plurality of yarns across the space between said carrier strips of part (a) along a path making an angle of from ten to eight degrees with said carrier strips, and (iii) causing each of said plurality of yarns to be restrained by at least one of said yarn restrainers on each of said two yarn carrier strips during each complete cycle of movement of said yarn laying means from a starting position midway between the two yarn carrier strips toward one of the two yarn carrier strips, back to the other yarn carrier strip, and finally back to the starting position;

(d) means for continuously supplying continuous yarns under constant light tension to the input section of said yarn laying means; and (e) actuating means for causing said yarn laying means to move back and forth across the space between said yarn carrier strips and simultaneously advancing said yarn carrier strips at such a speed as to leave, within a continuous zone extending between said yarn carrier strips and along the direction of advancement of the said yarn carrier strips, a regularly spaced array of yarns which is moved forward along with the yarn carrier strips and their associated yarn restrainers, wherein said yarn laying means comprise:

(f) a first sliding carriage capable of reciprocal motion along a first straight line direction with respect to the machine frame, said first sliding carriage having on one of its major surfaces a walled slot with its central axis oriented at a substantial angle to the direction of reciprocal motion and having on its other major surface structures defining a sliding track in which a suitably prepared component can slide reciprocally along a second straight line direction, said second straight line direction being disposed at a substantial angle to said first straight line direction;

(g) a second sliding carriage provided with structures which allow it to slide smoothly within the sliding track on said first sliding carriage, said second sliding carriage having on one end thereof means for carrying a small yarn array, said second sliding carriage also having on one surface thereof a cam follower projection;

(h) a guide plate fixed to the machine frame, said guide plate having therein a slot cam into which fits said cam follower projection from said second sliding carriage, said slot cam having camming surfaces in a shape which will constrain said means for carrying a small yarn array to follow, within a central zone centered between said carrier strips and having a width at least half the total distance between said carrier strips, a substantially linear path between said carrier strips at an angle thereto of between ten and eighty degrees;

(i) a guide bar fitting within said walled slot on said first sliding carriage; and (j) means for causing said guide bar, when actuated, to rotate in a circle, thereby causing said first sliding carriage to execute reciprocal linear motion relative to said guide plate, whereby said cam slot controls the motion of said cam follower and attached second sliding carriage, all of said components of said yarn laying means having dimensions and orientations such that said means for conveying a small yarn array moves in a sufficiently wide path to carry said small yarn array into a position where the yarns of said small array can be retrained by the yarn restrainers on both yarn carrier strips during each complete cycle of motion of said means for conveying a small yarn array.

6. A machine according to claim 5 wherein said slot cam includes on each end a widened section which allows said means for carrying a small array of yarn to move backward from its farthest position outside one line of yarn restrainers at an angle to the line of said restrainers substantially different from the angle of approach to the farthest position, whereby the formation, at a position outside the line of yarn carriers, of a loop of each yarn carried is promoted.

7. A machine according to claim 6, wherein said means for carrying a small array of yarns comprise:

(a) a yarn input guideboard having at least one eyelet therein for each yarn of the small array;

(b) a second yarn guideboard having at least one eyelet therein for each yarn of the small array, said eyelets in said second yarn guideboard being arranged in a linear pattern with at least one group of eyelets having substantially constant spacing between adjacent eyelets of each group and with a spacing between nearest eyelets of adjacent groups greater than the spacing within a single group but less than twice such spacing, said second yarn guideboard having a vertical position sufficiently high to pass over the tops of the yarn restrainers carried on the carrier strips in the portion of the travel path thereof at which additional yarns are added to the space array of yarns thereon;

(c) two yarn depressors, one on each side of said second yarn guideboard, which are long enough for the entire small array of yarns to pass underneath while maintaining the spacing corresponding to the pattern of eyelets in said second yarn guideboard, each of said yarn depressors being capable of vertical motion between a point above any portion of the yarn restrainers and carrier strips which lies inside the outermost point of reciprocating motion of said depressors and a point sufficiently below said second yarn guideboard so that the yarns passing between the edge of the depressor and the second guideboard will make an angle of at least thirty degrees with the direction line of the same yarns in the portion of their disposition between said depressor and the more remote line of said yarn restrainers; and (d) means for controlling the vertical positions of the two depressors so that as the second guideboard approaches one line of yarn restrainers, the outer depressor will be in its high position and the inner depressor will be in its low position.

8. A machine according to claim 7 wherein said means for controlling the vertical positions of the two depressors comprise toothed tracks on a thrust rod for each depressor, said thrust rods being attached on their opposite end from the depressor to the output of a single acting spring return air cylinder, both of said toothed tracks being engaged with a single rotatable spur gear positioned between them so that as one thrust rod moves upward by any incremental amount, the other thrust rod is constrained by the gear to move downward by the same incremental amount.

* * * * *